US007828506B1

(12) United States Patent
Young

(10) Patent No.: US 7,828,506 B1
(45) **Date of Patent: *Nov. 9, 2010**

(54) DUAL DRIVE DRYWALL LIFT SYSTEM

(75) Inventor: Larry P. Young, Grand Forks, ND (US)

(73) Assignee: Telpro, Inc., Grand Forks, ND (US)

( * ) Notice: Subject to any disclaimer, the term of this patent is extended or adjusted under 35 U.S.C. 154(b) by 495 days.

This patent is subject to a terminal disclaimer.

(21) Appl. No.: 11/782,331

(22) Filed: Jul. 24, 2007

(51) Int. Cl.
*B66D 1/12* (2006.01)

(52) U.S. Cl. ..... 414/787; 254/342

(58) Field of Classification Search ..... 414/11, 414/10, 12, 787; 254/342
See application file for complete search history.

(56) References Cited

U.S. PATENT DOCUMENTS 5,368,429 A * 11/1994 Young ..... 414/11
5,593,272 A * 1/1997 Green ..... 414/498
5,871,069 A * 2/1999 Carmitchel ..... 187/231
6,179,270 B1 * 1/2001 Higdon ..... 254/358
6,361,021 B1 * 3/2002 Brennan ..... 254/134.3 FT
6,705,597 B1 * 3/2004 Reilly et al. ..... 254/223
7,448,598 B1 * 11/2008 Elmlinger et al. ..... 254/338
7,484,713 B1 * 2/2009 Young ..... 254/342
7,556,464 B2 * 7/2009 Young et al. ..... 414/11
2004/0194361 A1 * 10/2004 Furlan et al. ..... 40/601
2005/0039984 A1 * 2/2005 Nickel ..... 182/141

* cited by examiner

*Primary Examiner*—Charles A Fox
(74) *Attorney, Agent, or Firm*—Neustel Law Offices

(57) ABSTRACT

A dual drive drywall lift system for efficiently lifting a panel either manually or through an external motor. The dual drive drywall lift system generally includes a lifting unit including at least one telescoping member, a first drive unit mechanically connected to the lifting unit, wherein the first drive unit selectively extends and retracts the telescoping member(s) outwardly via a manual force input member and a second drive unit mechanically connected to the lifting unit, wherein the second drive unit selectively extends and retracts the telescoping member(s) outwardly via a powered force applied to the second drive unit.

5 Claims, 13 Drawing Sheets

DUAL DRIVE DRYWALL LIFT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a lift system and more specifically it relates to a dual drive drywall lift system for efficiently lifting a panel either manually or through an external motor.

2. Description of the Related Art

Any discussion of the prior art throughout the specification should in no way be considered as an admission that such prior art is widely known or forms part of common general knowledge in the field.

Lift systems have been in use for years. Typically, lift systems are comprised of a telescoping structure and may be utilized for various purposes, such as but not limited to elevating a drywall panel. The panel is generally positioned upon the upper end of the telescoping structure, wherein the telescoping structure and panel extend upwards simultaneously. Various telescoping structures exist in the prior art, some of which are described in U.S. Pat. No. 5,368,429 (manual lifter) and U.S. Pat. No. 3,828,942 (manual lifter).

The prior lifts systems do not offer a lift system that may utilize an external motor to elevate the panel along with a manual lift source to elevate the panel. The utilization of both the motor and the manual source may be efficient in many applications, such as when the motor is utilized to elevate the panel a majority of the height and the manual source is utilized to fine tune the height of the panel. Because of the general lack of efficiency and practicality in the prior art there is the need for a new and improved dual drive drywall lift system for efficiently lifting a panel either manually or through an external motor.

BRIEF SUMMARY OF THE INVENTION

The general purpose of the present invention is to provide a dual drive drywall lift system that has many of the advantages of the lift systems mentioned heretofore. The invention generally relates to a lift system which includes a lifting unit including at least one telescoping member, a first drive unit mechanically connected to the lifting unit, wherein the first drive unit selectively extends and retracts the telescoping member(s) outwardly via a manual force input member and a second drive unit mechanically connected to the lifting unit, wherein the second drive unit selectively extends and retracts the telescoping member(s) outwardly via a powered force applied to the second drive unit.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a dual drive drywall lift system for efficiently lifting a panel either manually or through an external motor.

Another object is to provide a dual drive drywall lift system that may utilize an external motor (e.g. drill, etc.) to elevate the lift system.

An additional object is to provide a dual drive drywall lift system that may utilize a conventional manual source to fine tune the elevation of the lift system.

A further object is to provide a dual drive drywall lift system that includes a slip clutch to prevent the panel from being lifted past a desired point.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
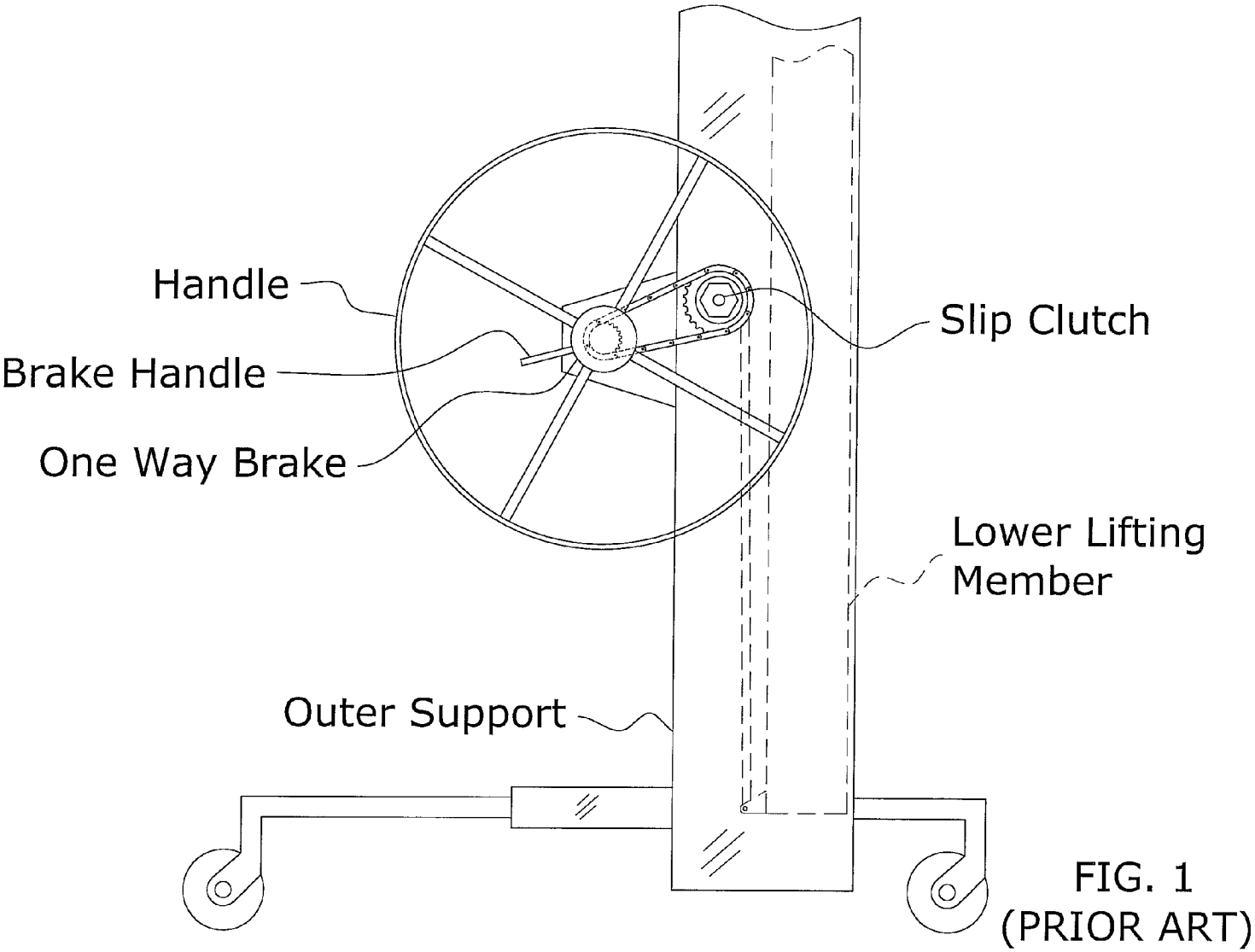
FIG. 1 (PRIOR ART)
FIG. 1 is a side view of a prior art telescoping drywall lifter utilizing a first drive unit mechanism in combination with a chain drive.

Turning now descriptively to the drawings, in which similar reference characters denote similar elements throughout the several views, FIGS. 1 through 13 illustrate a dual drive drywall lift system 10, which comprises a lifting unit including at least one telescoping member 24, a first drive unit 60 mechanically connected to the lifting unit, wherein the first drive unit 60 selectively extends and retracts the telescoping member(s) 24 outwardly via a manual force input member and a second drive unit 46 mechanically connected to the lifting unit, wherein the second drive unit 46 selectively extends and retracts the telescoping member(s) 24 outwardly via a powered force applied to the second drive unit 46.

B. Telescoping Drywall Lifter

The telescoping drywall lifter (i.e. lifting unit) is capable of lifting and lowering a load 12, such as but not limited to a drywall panel (e.g. plasterboard, paneling, wooden panels, composite panels, bricks and the like). The telescoping drywall lifter includes a plurality of legs 21, a lower lifting member 22, a plurality of telescoping lifting members 24 extending upwardly from the lower lifting member 22 and an upper support 26 as illustrated in FIG. 1.

Figure 4:
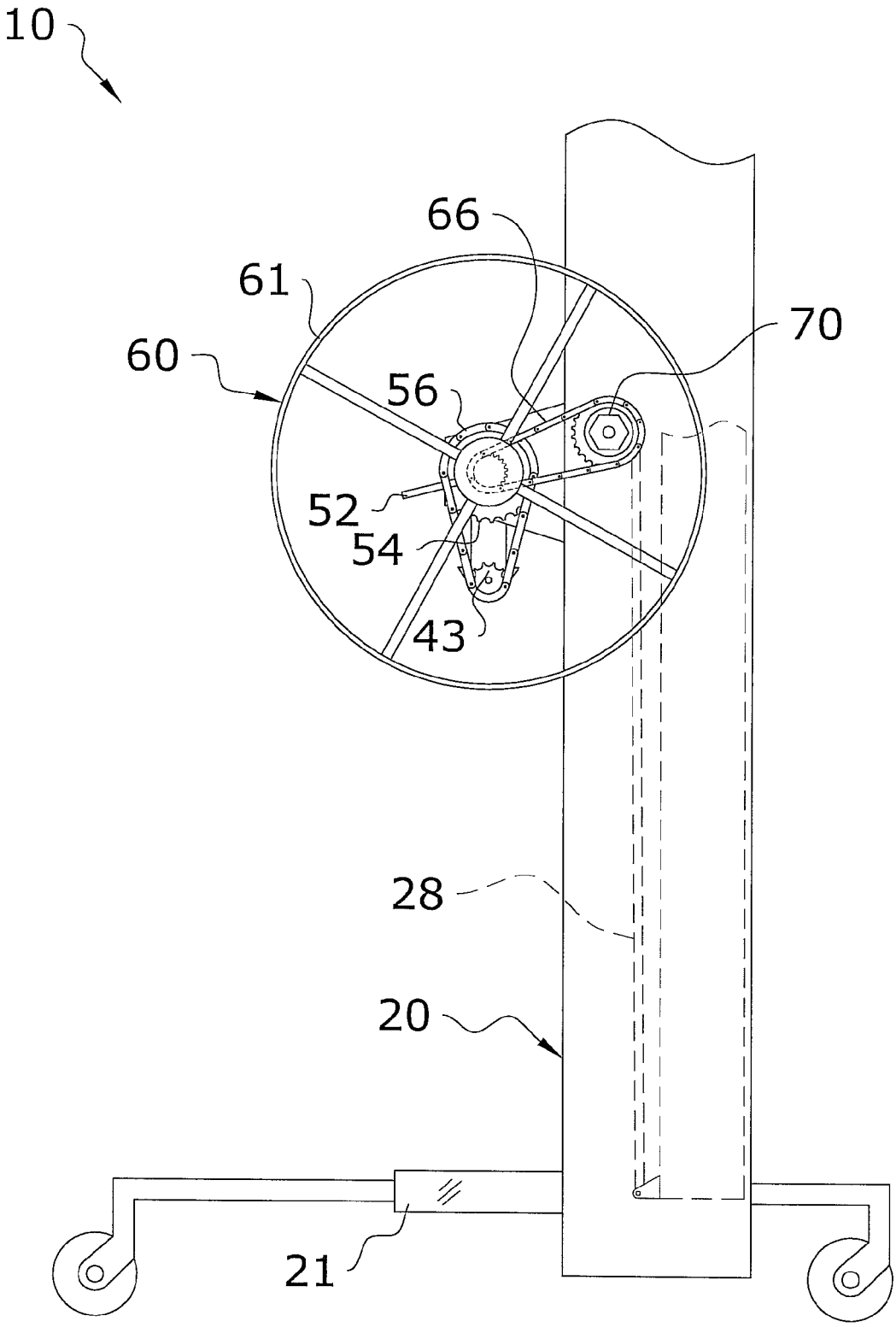
FIG. 4 is a side view of the first attachment kit attached to the chain driven telescoping drywall lifter.
Figure 5:
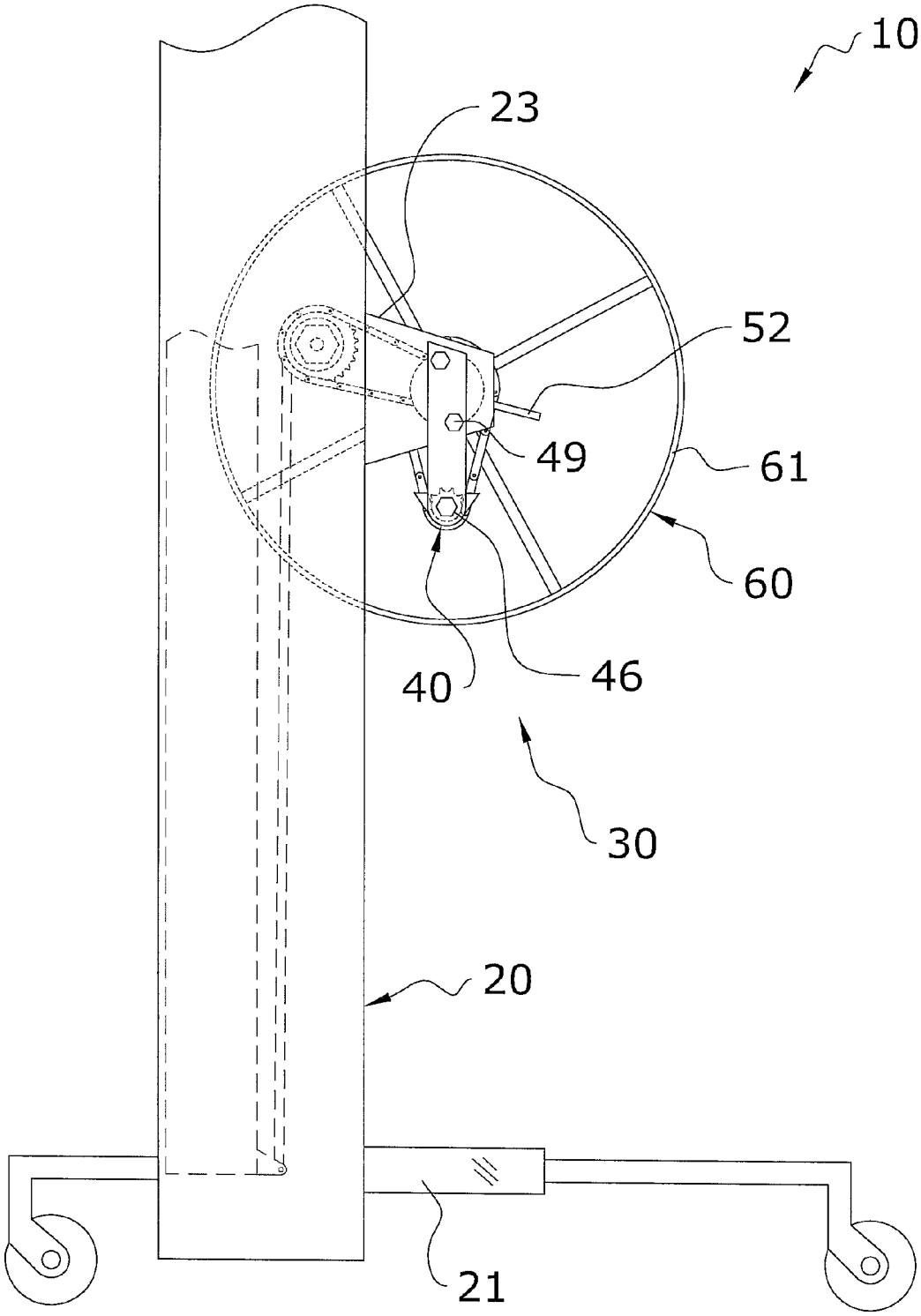
FIG. 5 is an opposing side view of the first attachment kit attached to the chain driven telescoping drywall lifter.

The lower lifting member 22 is vertically movable within an outer support 20 attached to the legs 21 as illustrated in FIG. 4 of the drawings. The outer support 20 is comprised of a tubular vertical structure that receives a significant portion of the telescoping structure when retracted.

The outer support 20 also includes a connecting portion 23, wherein a first attachment kit 30 or a second attachment kit 32 may be attached to the outer support 20 via the connecting portion 23. A guard may also extend from the outer support 20 and along the outer edges of the handle 61 of the first drive unit 60 to provide protection from various loads 12 for an operator of the present invention while utilizing the first drive unit 60.

It is appreciated that the telescoping drywall lifter may be comprised of various configurations common in the art, such as but not limited to a cable driven drywall lifter or a chain driven drywall lifter. U.S. Pat. No. 5,586,619 (hydraulic lifter) to Roland Young, U.S. Pat. No. 5,368,429 (manual lifter) to Roland Young and U.S. Pat. No. 3,828,942 (manual lifter) illustrate examples of conventional drywall lifters that may be utilized within the present invention and are hereby incorporated by reference herein.

C. First Drive Unit

Figure 7:
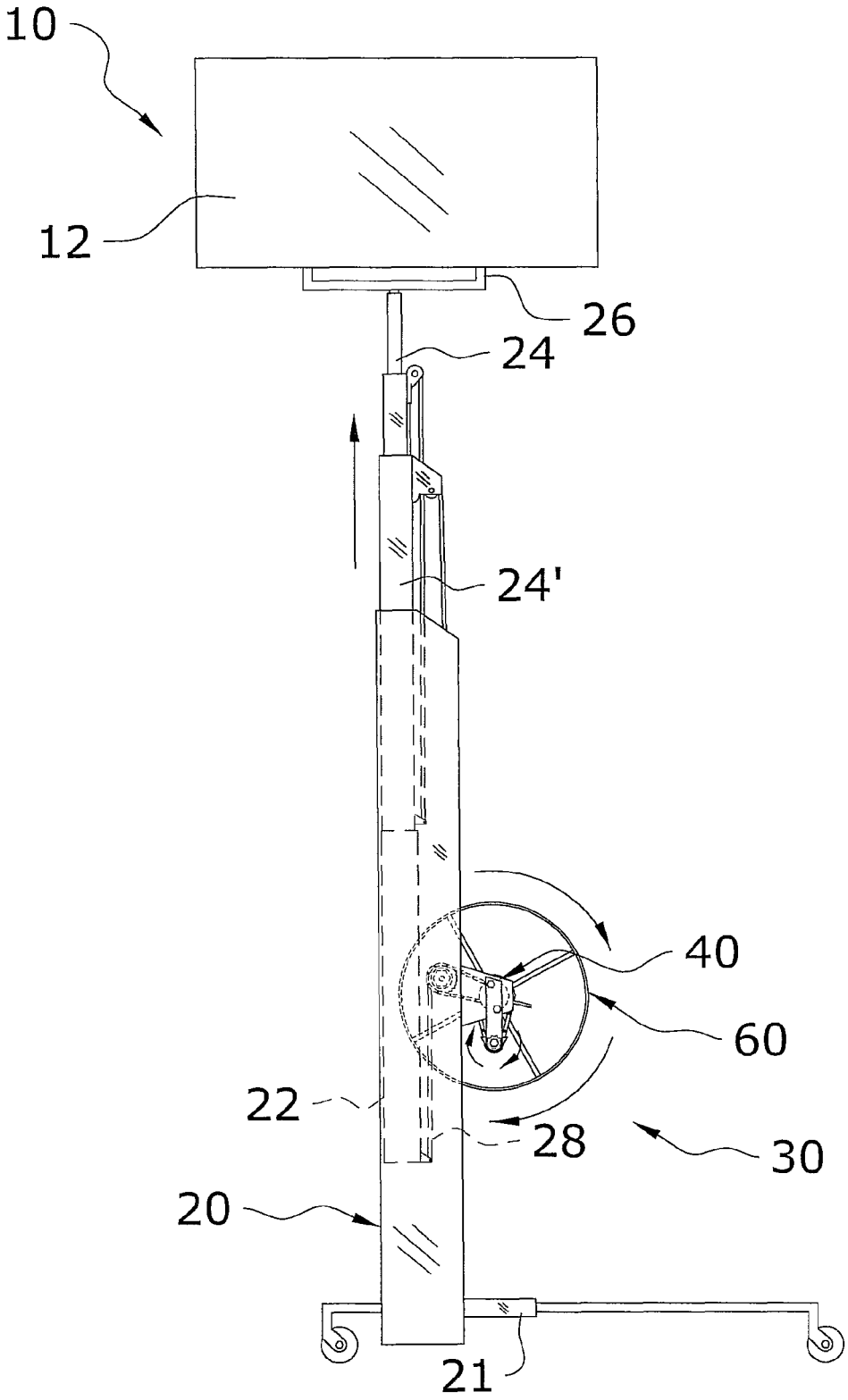
FIG. 7 is an opposing side view of the first attachment kit attached to the chain driven telescoping drywall lifter with the telescoping members being elevated by an external motor (not shown) operating the primary input drive.

The first drive unit 60 is utilized to mechanically lift and lower the lifting structure of the drywall lifter resulting in the corresponding lifting or lowering of a load 12 as illustrated in FIG. 7. The first drive unit 60 is comprised of a manually operated device. The first drive unit 60 includes a handle 61 and in the preferred embodiment is comprised of a steering wheel configuration.

Figure 8:
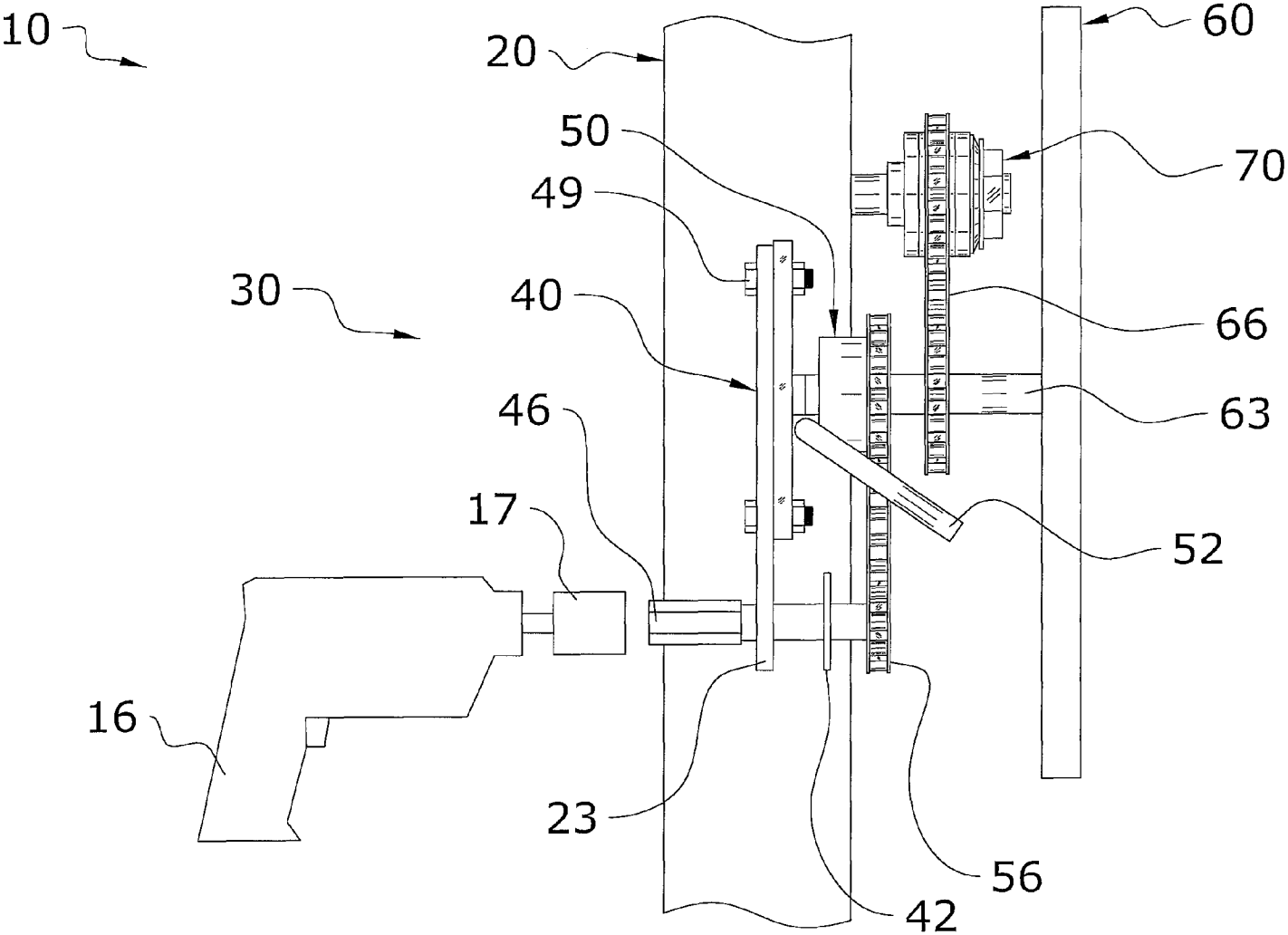
FIG. 8 is a front view of the first attachment kit attached to the chain driven telescoping drywall lifter, wherein an external motor (i.e. drill) is exploded from the second drive unit.
Figure 11:
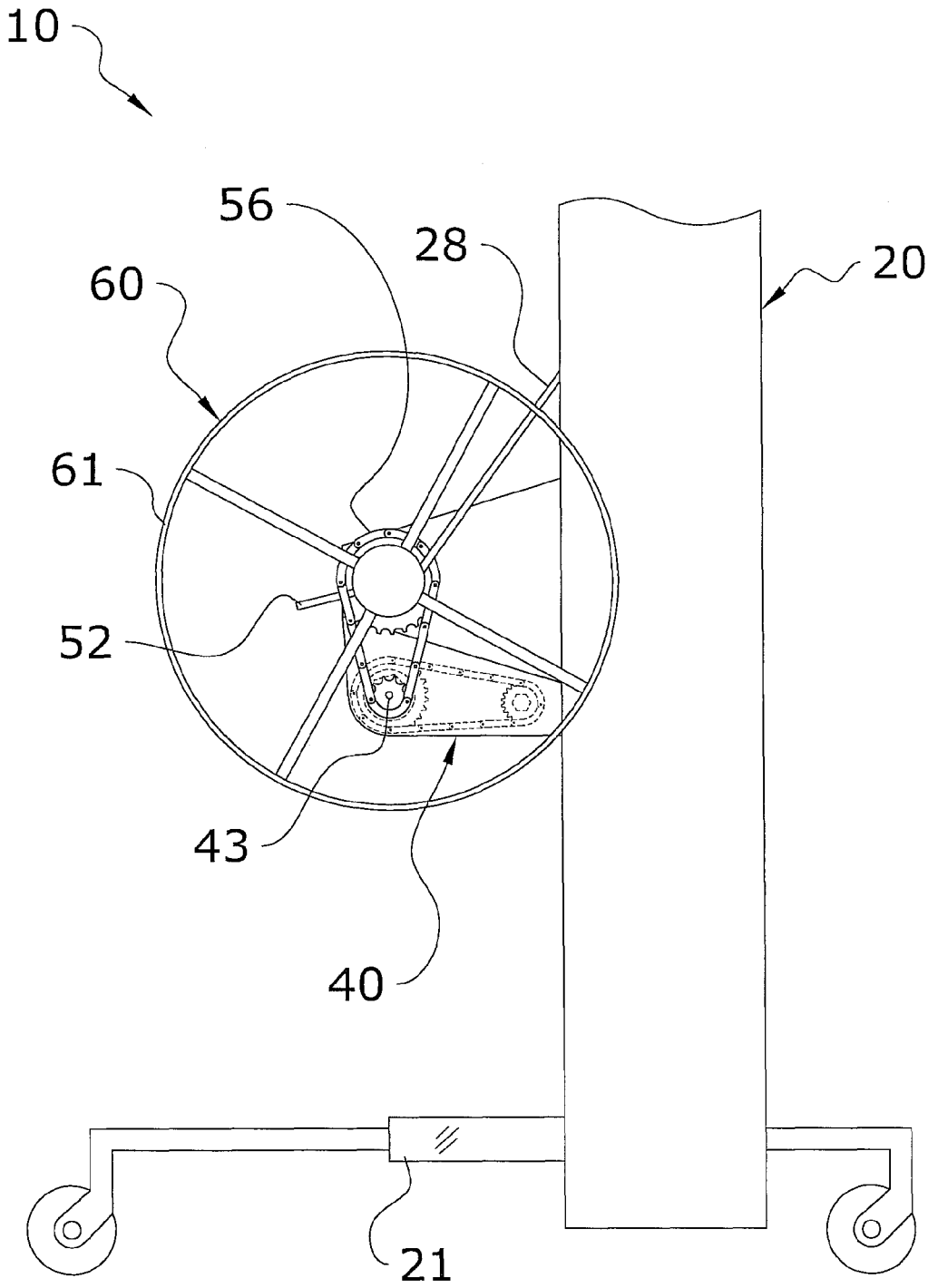
FIG. 11 is a side view of the second attachment kit attached to the cable driven telescoping drywall lifter.
Figure 12:
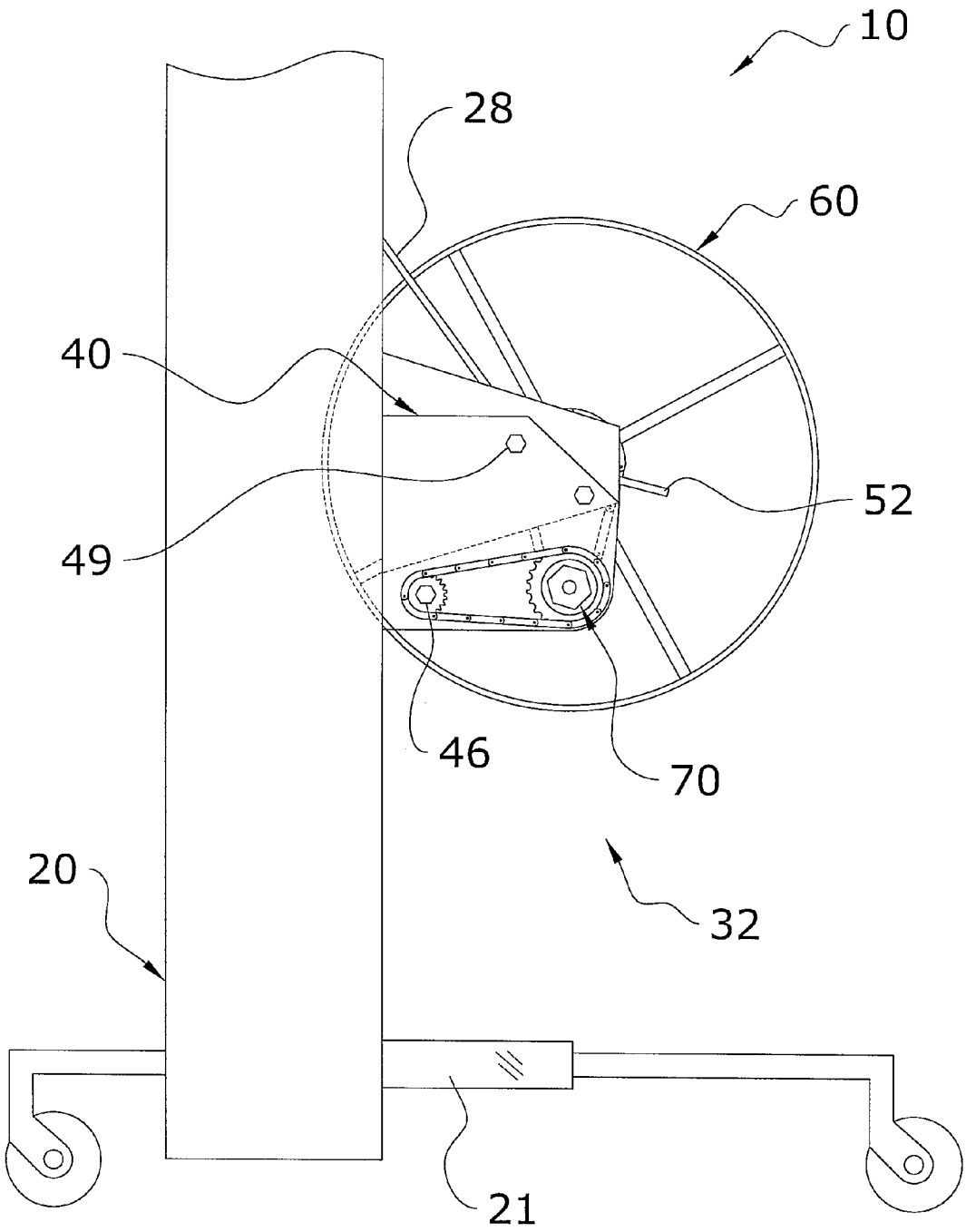
FIG. 12 is an opposing side view of the second attachment kit attached to the cable driven telescoping drywall lifter.
Figure 13:
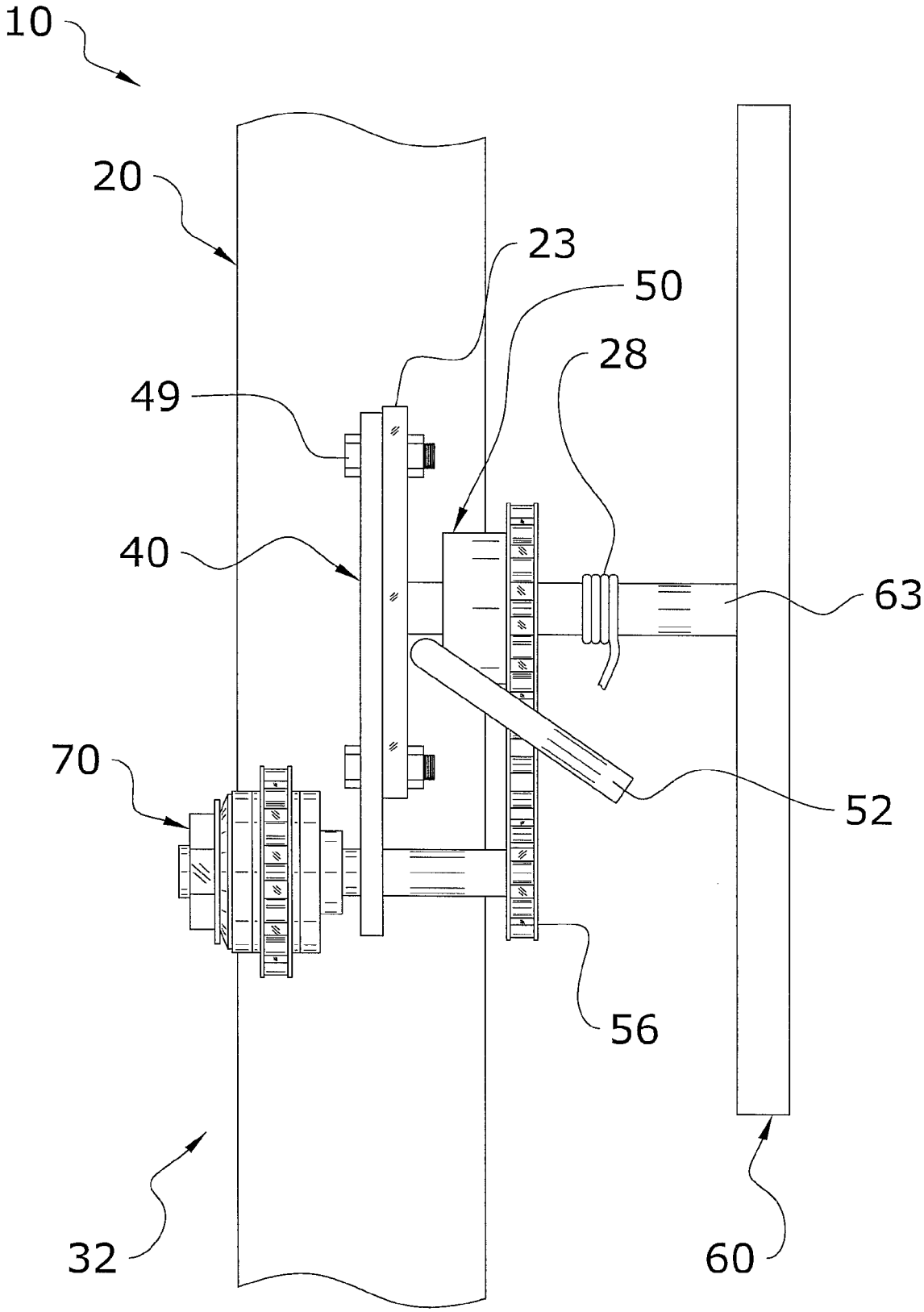
FIG. 13 is a front view of the second attachment kit attached to the cable driven telescoping drywall lifter, wherein an external motor (i.e. drill) is exploded from the second drive unit.

The first drive unit 60 is preferably directly connected to a brake unit 50 via a hub 63 as illustrated in FIGS. 8 and 13. The first drive unit 60 includes a first drive unit sprocket 64 to connect to a secondary sprocket 72 of a slip clutch 70. The first drive unit sprocket 64 and the secondary sprocket 72 are interconnected via a first elongated member 56. The first drive unit 60 may also be directly connected to the lower lifting member 22 and the telescoping lifting members 24 via the main elongated member 28 as illustrated in FIGS. 11 through 13, wherein the first drive unit sprocket 64 is omitted and the elongated member 28 (i.e. cable) wraps around the hub 63 as illustrated in FIG. 13.

D. Brake Unit

The brake unit 50 is capable of preventing the lowering of the load 12 up to a first torque limit which is comprised of a torque level that results in failure of the brake unit 50. A control lever 51 or similar structure is used to engage the brake unit 50 to prevent rotation of the first drive unit 60 and the second drive unit 46. The hub 63 of the first drive unit 60 directly connects the handle 61 to the brake unit 50, wherein rotating the handle 61 directly causes the brake unit 50 to rotate.

The brake unit 50 is connected to the first drive unit 60 and the second drive unit 46 to selectively prevent the telescoping drywall lifter from lowering the load 12 and also to allow an operator of the present invention to switch between the second drive unit 46 and the first drive unit 60 while preventing the load 12 from lowering. U.S. Pat. No. 3,828,942 to Young illustrates an exemplary brake unit 50 and is hereby incorporated by reference herein.

The brake unit 50 also includes a plurality of engaging members 54 circumscribing the outer perimeter of the brake unit 50, wherein the engaging members 54 receive a second elongated member 66. The second elongated member 66 provides a mechanical connection between the brake unit 50 and the second drive unit 46, wherein the second drive unit 46 and the first drive unit 60 are mechanically connected together via the brake unit 50. It is appreciated that the brake unit 50 may also include a separate sprocket mechanically attached to the brake unit 50 and hub 63 rather than the engaging members 54.

E. Slip Clutch

The slip clutch 70 prevents slippage up to a second torque limit. The slip clutch 70 is preferably adjustable to allow for adjustment of the second torque limit depending upon the application of usage. The second torque limit is less than the first torque limit to prevent damage to the brake unit 50 by the load 12 having an excessive weight. It is preferable that the second torque limit is significantly less than the first torque limit to prevent continued exposure of the brake unit 50 to excessively heavy loads 12 (e.g. 500 pounds or more).

The slip clutch 70 may be directly connected to the main elongated member 28 via the secondary sprocket 72 (i.e. between the main elongated member 28 and the first drive unit sprocket 64) to prevent an overloading force from being applied either through the first drive unit 60 or the second drive unit 46. The slip clutch 70 may also be directly connected to the second drive unit 46 via the secondary sprocket 72 (i.e. between the power drive sprocket 47 and the inner sprocket 43) before the first drive unit 60 in a transfer path of power from the second drive unit 46 to the main elongated member 28, wherein the slip clutch 70 prevents the second torque limit from being exceeded solely through the second drive unit 46.

F. Second Drive Unit

The second drive unit 46 is driven by a powered source 16. The powered source 16 is preferably comprised of a rotating external motor 16. In the preferred embodiment the external motor 16 is comprised of a powered drill, wherein the drill includes an adapter 17 to attach to the second drive unit 46. It is appreciated however, that the present invention may utilize various external motors 16 to rotate the second drive unit 46.

The adapter 17 is preferably comprised of a socket and is positionable over the second drive unit 46, wherein the second drive unit 46 is preferably comprised of a hex nut configuration. Rotation of the second drive unit 46 subsequently rotates the brake unit 50 and first drive unit 60 which in turn extends the telescoping lifting members 24 outwardly.

The second drive unit 46 is preferably mechanically connected to the first drive unit 60 through a series of elongated members (e.g. chain) and sprockets as illustrated in FIGS. 2 through 13. It is appreciated that the present invention may utilize various mechanical configurations rather than chains and sprockets to transfer power between the second drive unit 46, the brake unit 50, the first drive unit 60 and the telescoping lifting members 24, such as but not limited to belts, pulleys and/or cables.

G. First Attachment Kit and Assemblage

The first attachment kit 30 is illustrated in FIGS. 2 through 8 and preferably attaches to a conventional chain driven telescoping drywall lifter, wherein the main elongated member 28 of the chain driven telescoping lifting member 24 is comprised of a chain configuration. The first attachment kit 30 allows the conventional telescoping drywall lifter to be utilized with either a manual force (e.g. handle 61, lever, foot pedal, etc.) or a power driven force to extend the telescoping lifting members 24. The first attachment kit 30 includes a first drive unit 60 mechanically connected to the slip clutch 70, a brake unit 50 connected to the first drive unit 60 and a second drive unit 46 mechanically connected to the brake unit 50.

Figure 2:
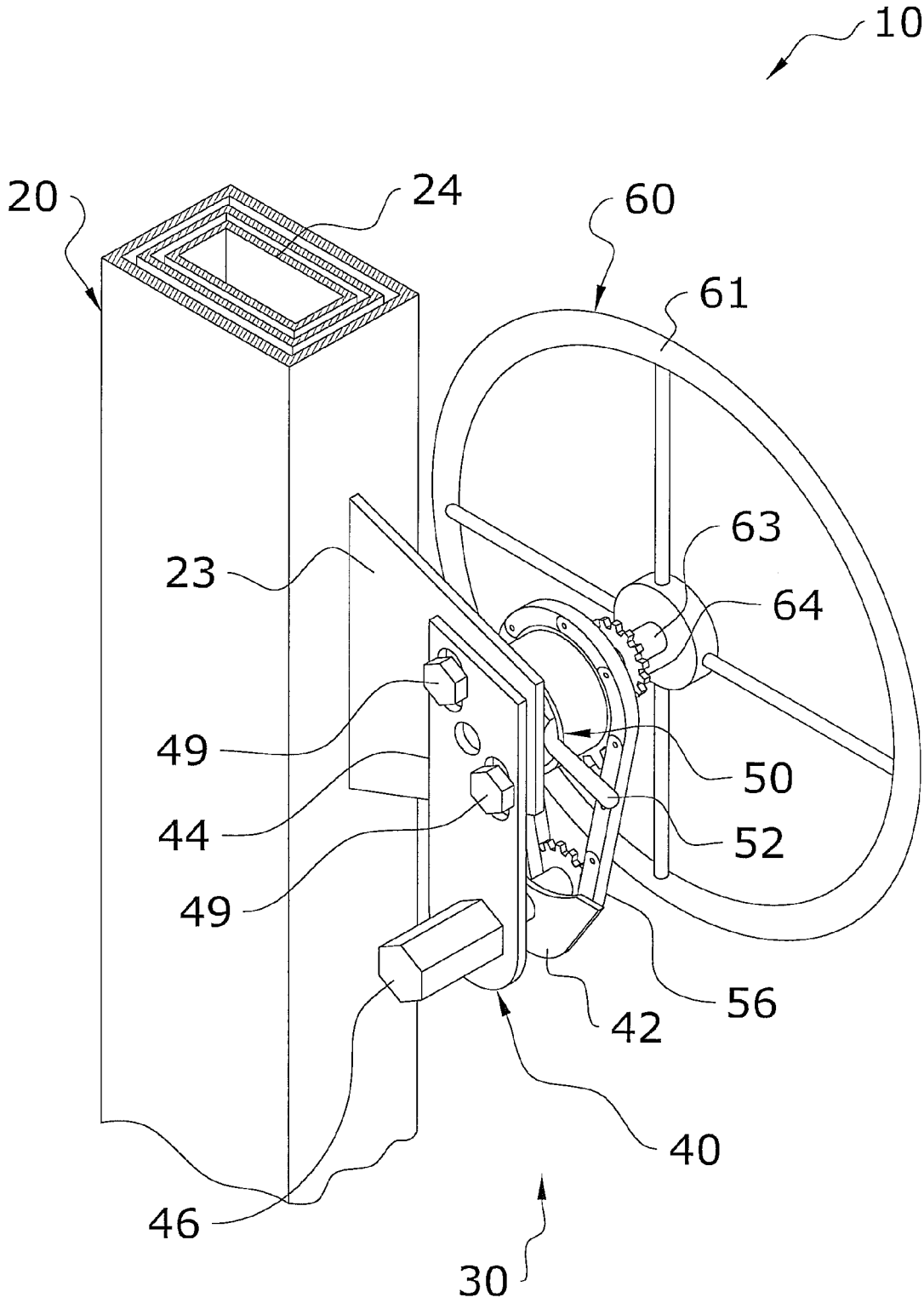
FIG. 2 is an upper perspective view of the first attachment kit attached to the chain driven telescoping drywall lifter, wherein the telescoping drywall lifter is partially cutaway.
Figure 3:
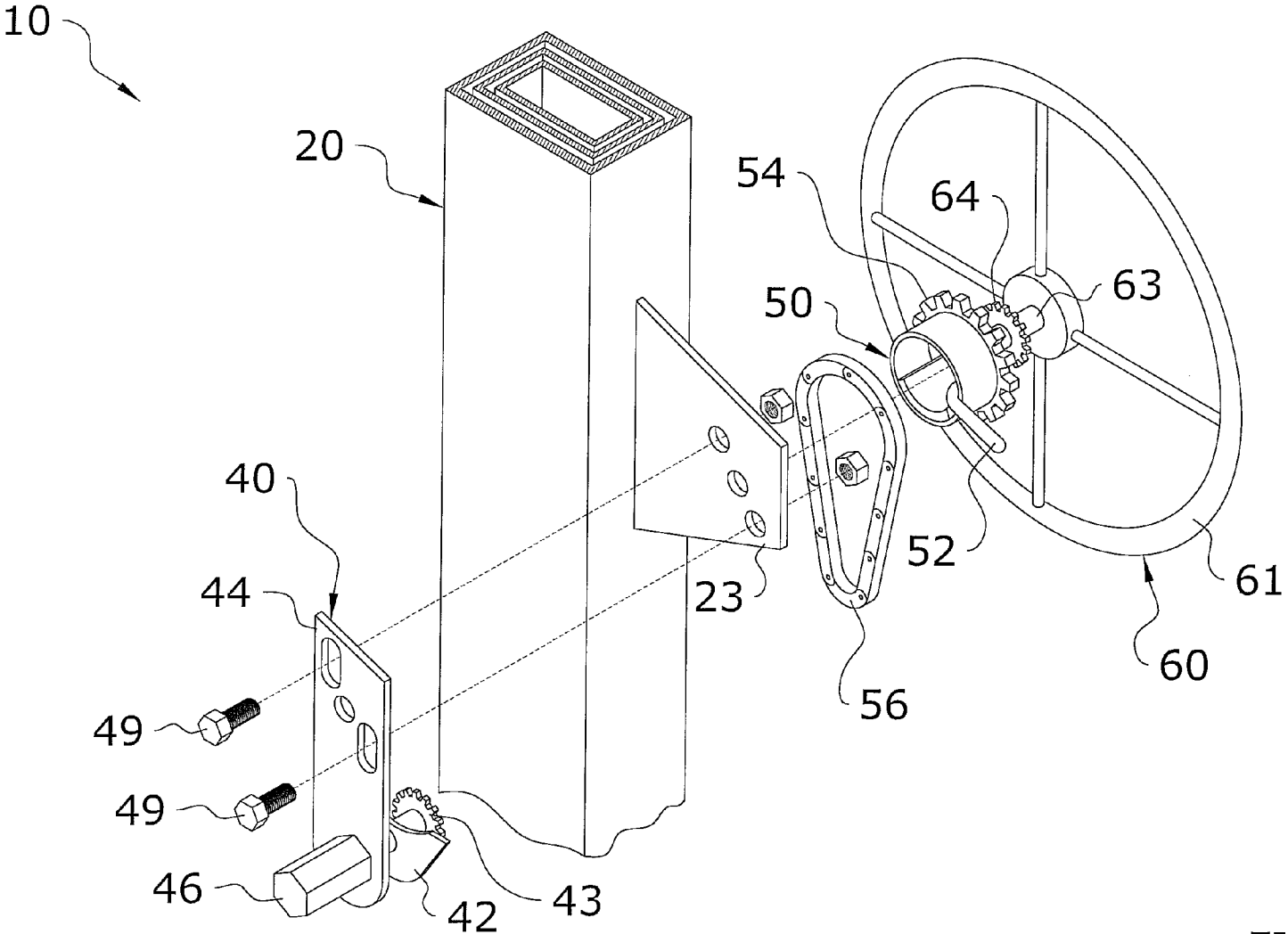
FIG. 3 is an upper perspective view of the first attachment kit exploded from the chain driven telescoping drywall lifter, wherein the telescoping drywall lifter is partially cutaway.

When assembling the first attachment kit 30 with the telescoping drywall lifter, the plate structure 40 and the first drive unit 60 (including the brake unit 50) are attached to opposing sides of the connecting portion 23 via various fasteners 49 and/or brackets as illustrated in FIGS. 2 and 3. The plate structure 40 of the first attachment kit 30 preferably includes an inner plate 42 and an outer plate 45.

An inner sprocket 43 preferably extends from the inner plate 42 opposite the outer plate 45 for mechanically connecting with the engaging members 54 of the brake unit 50. The second drive unit 46 is directly connected the inner sprocket 43 via a shaft and extends from the outer plate 45 opposite the inner plate 42 as illustrated in FIG. 3.

A first elongated member 56 is positioned around the hub 63 and upon the first drive unit sprocket 64, wherein the elongated member is subsequently positioned around the secondary sprocket 72 of the slip clutch 70 to interconnect the first drive unit 60 with the slip clutch 70. A second elongated member 66 is also positioned around the engaging members 54 of the brake unit 50 and the inner sprocket 43 of the plate structure 40 to mechanically connect the second drive unit 46 to the brake unit 50 and thus first drive unit 60 and main elongated member 28.

H. Second Attachment Kit and Assemblage

The second attachment kit 32 is illustrated in FIGS. 9 through 13 and preferably attaches to a conventional cable driven telescoping drywall lifter, wherein the main elongated member 28 of the cable driven telescoping lifting member 24 is comprised of a cable configuration. The second attachment kit 32 allows the conventional telescoping drywall lifter to be utilized with either a manual force or a power driven force to extend the telescoping lifting members 24. The second attachment kit 32 includes a first drive unit 60 connected to the main elongated member 28, a brake unit 50 connected to the first drive unit 60, a slip clutch 70 and a second drive unit 46 mechanically connected to the brake unit 50.

Figure 9:
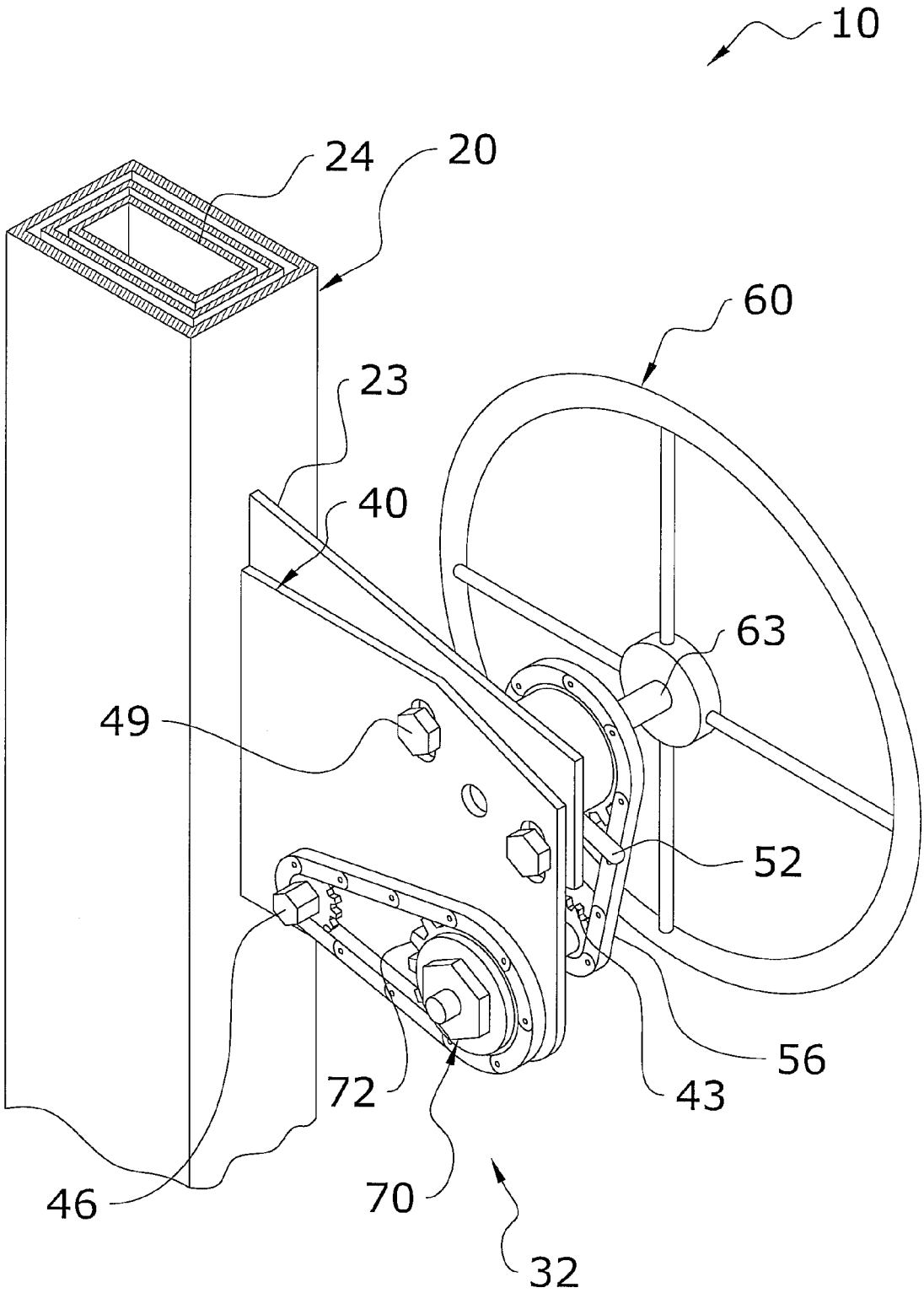
FIG. 9 is an upper perspective view of the second attachment kit attached to the telescoping drywall lifter, wherein the telescoping drywall lifter is partially cutaway and wherein the telescoping drywall lifter is comprised of a cable driven configuration.
Figure 10:
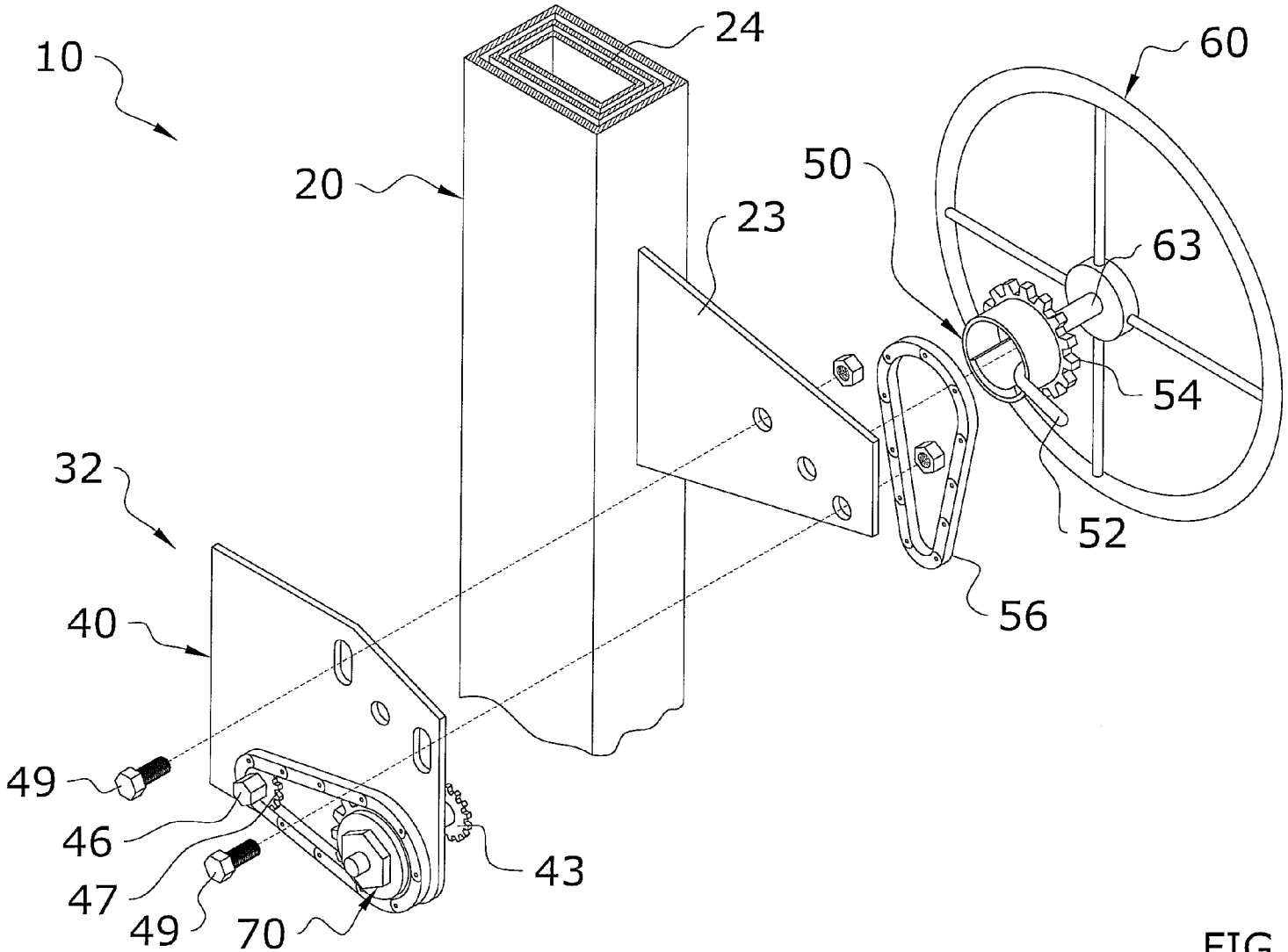
FIG. 10 is an upper perspective view of the second attachment kit exploded from the cable driven telescoping drywall lifter, wherein the telescoping drywall lifter is partially cutaway.

When assembling the second attachment kit 32 with the telescoping drywall lifter, the plate structure 40 and the first drive unit 60 (including the brake unit 50) are attached to opposing sides of the connecting portion 23 via various fasteners 49 and/or brackets as illustrated in FIGS. 9 and 10. An inner sprocket 43 preferably extends from the outer plate 45 opposite the slip clutch 70. The inner sprocket 43 mechanically connects with the engaging members 54 of the brake unit 50 via the first elongated member 56. The first elongated member 56 provides a mechanically connection from the second drive unit 46 to the brake unit 50 and thus first drive unit 60 and main elongated member 28.

The slip clutch 70 is directly connected to the inner sprocket 43 on an opposing side of the plate structure 40 via a shaft. The secondary sprocket 72 of the slip clutch 70 is connected to the second drive unit 46 via the second elongated member 66 as illustrated in FIGS. 9 through 12.

The main elongated member 28 (i.e. cable) selectively wraps around the hub 63 as the telescoping lifting members 24 are being extended, wherein the first drive unit 60 and hub 63 function in a similar manner to a winch in the cable driven telescoping drywall lifter embodiment. It is appreciated that the present invention may be sold and assembled as an attachment kit or the present invention may be integrally manufactured with the telescoping drywall lifter.

I. Operation of Present Invention

In use, a load 12 (e.g. drywall sheet, etc.) is positioned upon the upper support 26 of the drywall lifter. The external motor 16 (e.g. powered drill, etc.) is mechanically connected to the second drive unit 46 and the second drive unit 46 is rotated via the power of the external motor 16. The rotation of the second drive unit 46 subsequently extends the telescoping lifting members 24 and load 12 upwards as illustrated in FIG. 7.

Figure 6:
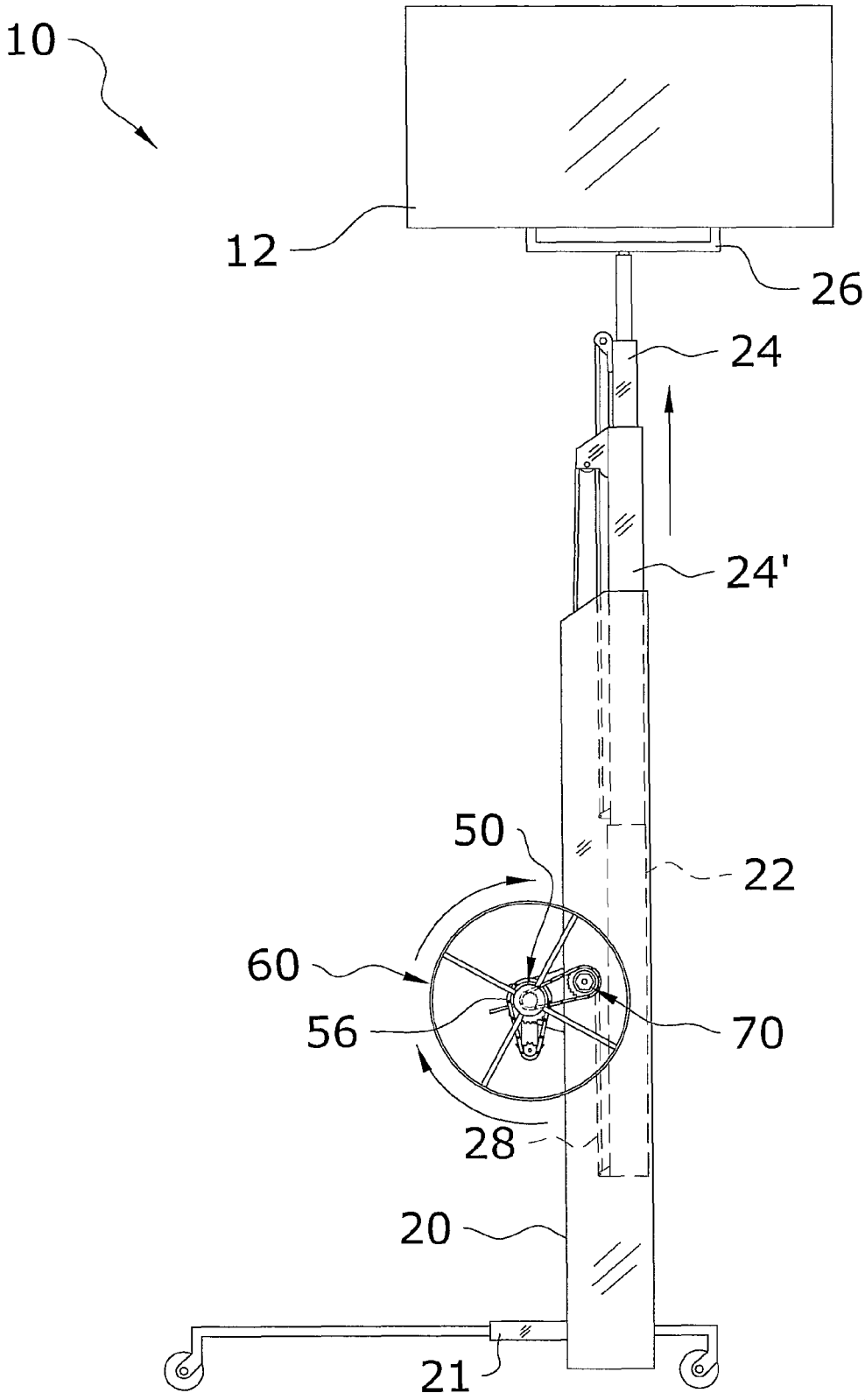
FIG. 6 is a side view of the first attachment kit attached to the chain driven telescoping drywall lifter with the telescoping members being elevated by the first drive unit.

Utilizing the external motor 16 and the second drive unit 46 prevents the operator from manually working excessively to raise loads 12 substantial heights. When the load 12 is substantially near the desired height, the external motor 16 is preferably stopped thus stopping the rotation of the second drive unit 46 and also stopping the elevating of the load 12. The operator now operates the first drive unit 60 to fine tune the height of the load 12 to ensure that the load 12 is at the desired and precise height as illustrated in FIG. 6.

When utilizing the first attachment kit 30, if the rotational force of either the second drive unit 46 or the first drive unit 60 exceeds the second torque limit, then the slip clutch 70 correspondingly slips reducing the force applied to the telescoping lifting structure thereby preventing damage to the drywall lifter and to the load 12 being positioned. When utilizing the second attachment kit 32, the slip clutch 70 solely prevents the powered drive input from exceeding the second torque limit; however it is appreciated that the slip clutch 70 in the second attachment kit 32 may be configured to also work in combination with the first drive unit 60. The load 12 may be lowered at any time by releasing the brake unit 50. The handle 61 of the first drive unit 60 is also preferably held and rotated accordingly when releasing the brake unit 50 to prevent the load 12 from falling too quickly or to assist the telescoping lifting members 24 downwards.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An attachment kit to attach to a lifting unit, wherein said attachment kit selectively extends and retracts at least one telescoping member of said lifting unit from said lifting unit via either a manual force input member or a powered force applied to said attachment kit, wherein said attachment kit comprises:

a rotatable first drive unit including the manual force input member;

a rotatable second drive unit comprised of a hexagonal shape to provide said powered force via an external motor; and a brake unit to connect between said first drive unit and said second drive unit, wherein said brake unit provides a braking force to said first drive unit and said second drive unit.

2. The attachment kit of claim 1, including an inner sprocket mechanically connected to said second drive unit.

3. The attachment kit of claim 2, including an attachment plate connected between said inner sprocket and said second drive unit.

4. The attachment kit of claim 3, including at least one elongated member to mechanically connect said brake unit to said inner sprocket.

5. The attachment kit of claim 1, including a slip clutch to mechanically connect to said second drive unit.

* * * * *